US007172505B2

(12) United States Patent
Vancura

(10) Patent No.: US 7,172,505 B2
(45) Date of Patent: Feb. 6, 2007

(54) SLOT MACHINE BONUS INITIATED BY PLURAL QUALIFICATIONS

(75) Inventor: Olaf Vancura, Las Vegas, NV (US)

(73) Assignee: Progressive Gaming International Corporation, Las Vegas, NV (US)

( * ) Notice: Subject to any disclaimer, the term of this patent is extended or adjusted under 35 U.S.C. 154(b) by 24 days.

(21) Appl. No.: 10/166,976

(22) Filed: Jun. 10, 2002

(65) Prior Publication Data

US 2003/0228897 A1 Dec. 11, 2003

(51) Int. Cl.
*A63F 9/24* (2006.01)

(52) U.S. Cl. ..... 463/16

(58) Field of Classification Search ..... 463/11, 463/12, 13, 16–20, 25; 273/138.1, 138.2, 273/143 R, 139

See application file for complete search history.

(56) References Cited

U.S. PATENT DOCUMENTS 4,836,546 A * 6/1989 DiRe et al. ..... 463/18
5,092,598 A * 3/1992 Kamille ..... 273/139
5,788,573 A * 8/1998 Baerlocher et al. ..... 463/16
6,047,963 A 4/2000 Pierce et al.
6,089,976 A * 7/2000 Schneider et al. ..... 463/16
6,159,097 A * 12/2000 Gura ..... 273/139
6,173,955 B1 1/2001 Perrie et al.
6,315,664 B1 * 11/2001 Baerlocher et al. ..... 273/139
6,398,644 B1 6/2002 Perrie et al.
6,722,983 B2 * 4/2004 Kaminkow et al. ..... 463/20
2003/0224850 A1 * 12/2003 Anderson et al. ..... 463/20

FOREIGN PATENT DOCUMENTS

AU 9748484 * 7/1998
GB 2144644 A * 3/1985

* cited by examiner

*Primary Examiner*—Mark Sager
*Assistant Examiner*—Robert Mosser
(74) *Attorney, Agent, or Firm*—Dorr, Carson & Birney, P.C.

(57) ABSTRACT

A multi-stage method qualifies a player for a bonus game. If two stages are used, the first has the player aligning a combination including at least one trigger symbol. The second stage uses the trigger symbols, reel symbols, other secondary mathematically related elements, or elements associated therewith, to qualify the player for the bonus game. The player interacts during the qualification process by providing input to the second stage.

17 Claims, 3 Drawing Sheets

SLOT MACHINE BONUS INITIATED BY PLURAL QUALIFICATIONS

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Field of the Invention

Slot players continue to demand more interaction. Dwindling are the days in which players are captivated upon inserting one to three coins, pulling the handle, and waiting to see the outcome of the spin. Today's slot players want more to do in the form of player choices as part of the game play. These choices are now designed into the play of state-of-the-art slot machines.

Too, today's slot players have shown an affinity for so-called bonus games, or games within a game. A typical bonus game provides a break from the traditional reel-spinning base-game portion of the wagering experience. Once in the bonus game, the player is treated to an experience in which no additional wager is required, and yet the player is generally assured of winning an award. Too, the bonus game typically "plays" quite differently than the base game. For example, it may involve the player choosing from among several objects (WMS Filthy Rich, Atronic Sphinx, IGT Little Green Men, etc.), a game of strategy (Mikohn Yahtzee, Mikohn Battleship), spinning a physical wheel located in the top-box (Anchor Wheel of Gold, IGT Wheel of Fortune), dropping a ball through a Pachinko forest (Mikohn Boingo), or other possibilities (Anchor Pinball, Barcrest Run for the Money, etc.).

A bonus game is generally initiated via a special combination of so-called trigger symbols within the base game. To date, initiation within the base game has been done in one of two ways: via line combination or scattered combination.

A line consists of multiple symbols appearing on the same payline. The symbols may appear left-to-right, right-to-left, or anywhere on the line. Consider a 5 reel game with 3 reel positions shown on each of the reels, and 9 paylines. An example of a line combination triggering the bonus game is that three trigger symbols may be required to appear left-to-right and adjacent starting with the leftmost reel. Once the three triggers are aligned in such a fashion on an active payline, the bonus game is initiated. An example is shown in FIG. 1.

On the other hand, a scattered combination is also called an "appearing anywhere" combination. Generally, three or more symbols appearing anywhere are utilized. An example of this is shown in FIG. 2.

The prior equipment does not deviate from the above in terms of qualifying the player to play a bonus game. Some games, after the player has qualified, make use of the trigger symbols. For example, in IGT's Catch a Wave slot machine, aligning three trigger symbols in a scatter formation qualifies the player for the bonus. The bonus consists of allowing the player to select one of the trigger symbols, which in turn randomly reveals a numerical award. As another example, in WMS's Monopoly Money Grab, aligning three trigger symbols on an active payline qualifies the player for the bonus. The player is prompted to choose one of the trigger symbols, which in turn randomly reveals the type of bonus that will occur. The screen then changes, and the type of bonus chosen is played. Alternately, (e.g., Silicon Gaming game show type of game) there exists a format in which once the player has qualified for the bonus game (via one or more trigger symbols in the proper locations), an intermediate screen randomly selects the type of bonus that will occur. The screen then changes, and the type of bonus randomly selected is played.

What is in common with all of the above approaches is that the player qualifies for the bonus game in one step from the base game. While at first thought this might appear appealing, it has several difficulties.

A first difficulty is that, given the frequency of many bonus games (occurring perhaps every 80–120 spins on average), many players will suffer through long drought periods in between bonus games. Because a major goal of most players is to achieve the bonus game, a long period of wagering between bonus games serves to discourage the player. Too, since the typical base game is simply a "wager and wait" affair, the player missing out on the bonus game is also missing out on player interaction and missing out leads to additional discouragement.

The second difficulty is that it is desirable to have the player occasionally (with more trigger symbols) play a bonus game of more value. For example, a bonus game in which the player qualified with 4 trigger symbols might be worth 3 times as much as a bonus game in which the player qualified with 3 trigger symbols, and so forth. Having the same bonus worth potentially different amounts (for example, depending on the number of initiating trigger symbols) helps hold a player's interest. However, practically speaking (because the trigger symbols also occupy space on the reels), the relative probability of the player entering the bonus game with 4 (or 5) triggers drops exponentially from that of 3 triggers.

The method and apparatus described herein solves these problems by using a two step or two stage method of bonus qualification. The first step or first stage occurs at a much greater frequency than a one step or one stage bonus qualification. Therefore he does not suffer through the long period of wagers before potentially qualifying, and this keeps the player's interest in the game high. The second stage provides the player with the opportunity to provide player input, and possibly enter into a bonus event. Through appropriate selection of frequencies of each stage, a game may be designed with a much higher payoff potential, for a given number of trigger symbols, than can be achieved in a one step or one stage bonus event.

It is an advantage of the instant method and apparatus that players enjoy more interaction.

It is a further advantage of the instant method and apparatus that players are less likely to perceive long periods of drought between visits to a bonus game.

It is a further advantage of the instant method and apparatus that the desired frequencies of visits to the bonus game may be precisely controlled without having to clutter the reels with many of a bonus triggering symbols.

It is a further advantage of the instant method and apparatus that the desired relative frequencies of relative values of the bonus game may be precisely controlled.

It is a further advantage of the instant method and apparatus that different types of bonus games can be initiated from a common set of triggering symbols; hence the reels need not be cluttered with many different types of bonus triggering symbols.

2. Description of Related Art Including Information Disclosed Under 37 CFR 1.97 AND 1.98

None

BRIEF SUMMARY OF THE INVENTION

The instant method and apparatus utilizes a multi-stage method to qualify the player for a bonus game. Preferably, two stages are used. The first comprises the player aligning a combination including at least one trigger symbol. The second utilizes the trigger symbols, or other secondary mathematical means, to qualify the player for the bonus game. Preferably, the player interacts (that is, provides input to) the second stage of this method.

DETAILED DESCRIPTION OF THE INVENTION

The examples disclose how to use the instant two-stage method as a multiplier for frequency to get into the bonus game. The instant method and apparatus use at least a two-step or multi-stage method to qualify the player for a bonus game. In the preferred embodiment, two stages are used. The first stage comprises the player aligning a combination having at least one trigger symbol. The trigger symbols could, in principle, take a variety of forms thematic to the game in which they are used. The second stage utilizes an associated attribute of the trigger symbols, or other secondary mathematics, to qualify the player for the bonus game. Preferably, the player interacts (that is, provides input to) the second stage of this method. In the examples below the steps are numbered and are keyed to the corresponding figures.

Figure 1:
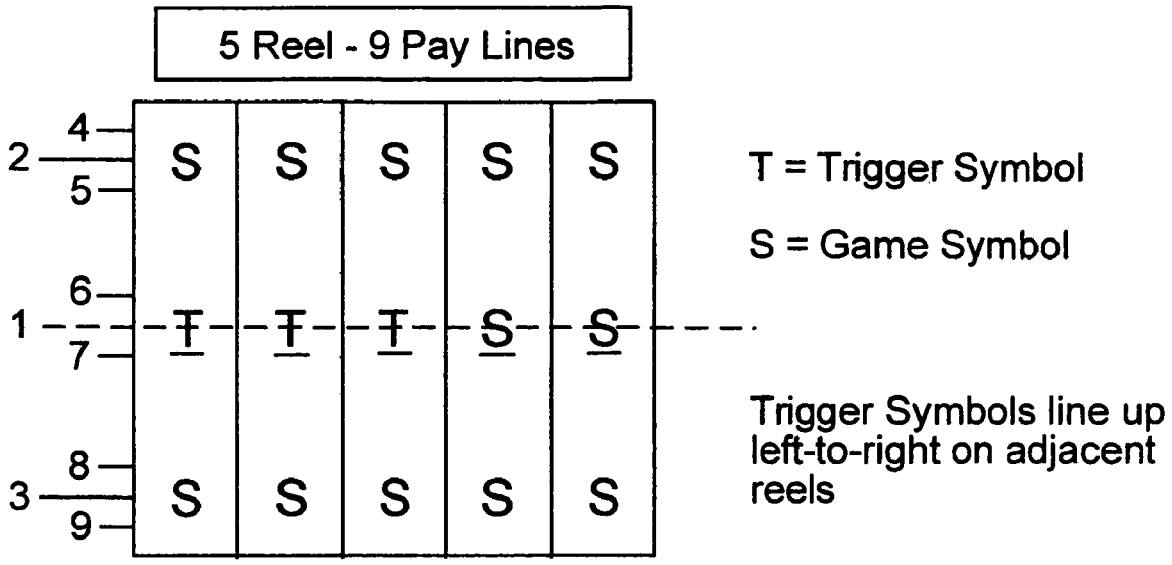
Fig. 1 ( Prior Art )
FIG. 1 is a diagram of a slot machine wherein three trigger symbols appear on a payline.
Figure 2:
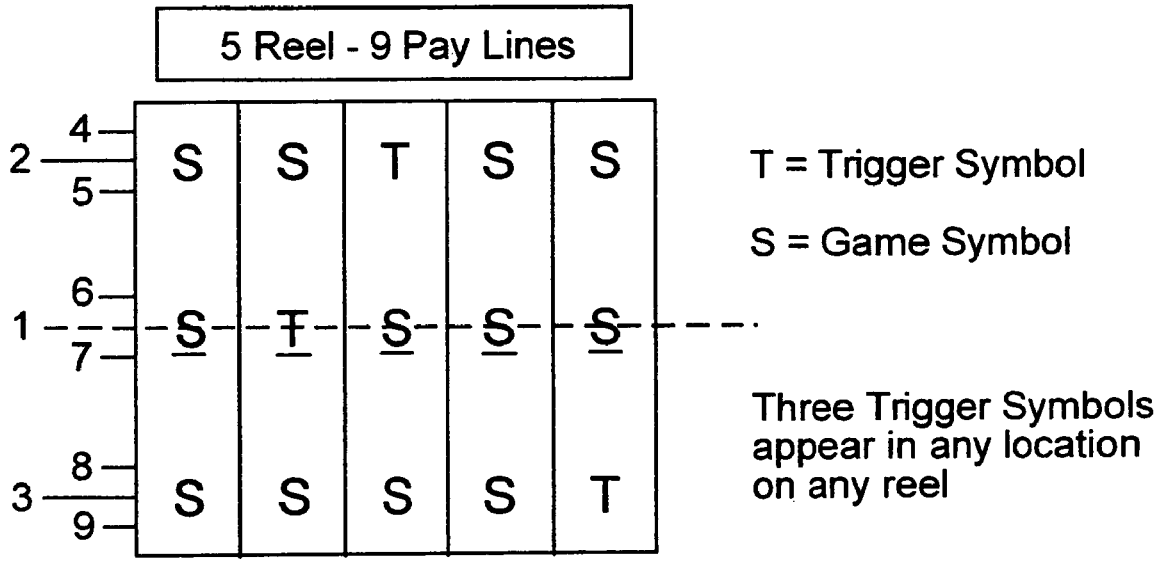
Fig. 2 ( Prior Art )
FIG. 2 is a diagram of a slot machine wherein three trigger symbols appear in a scatter pattern.
Figure 3:
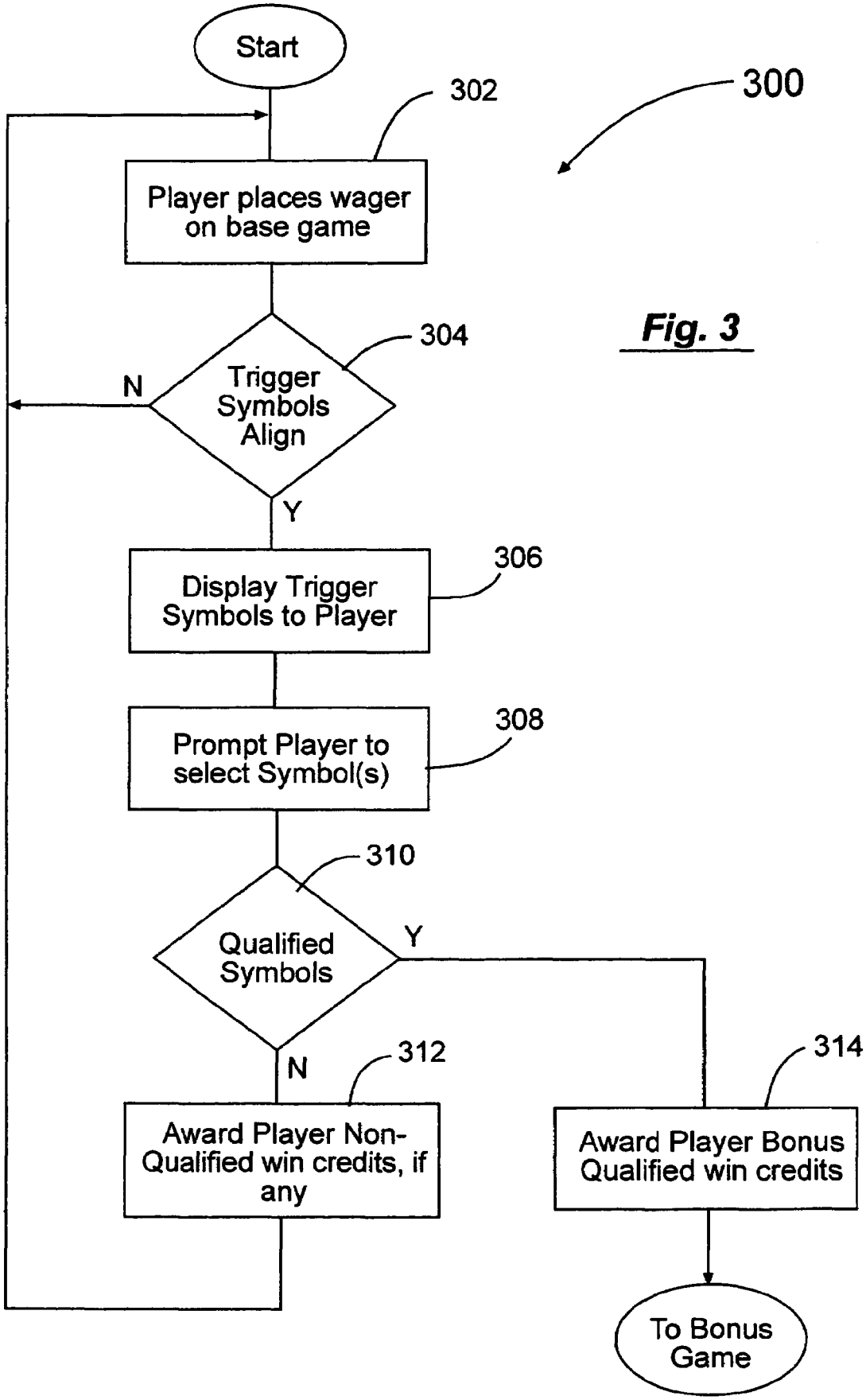
FIG. 3 is a flow diagram of a multi-stage bonus event.

In operation and referring to FIG. 3, there is an example 300 of qualifying a player for a bonus game using two steps or stages on a slot machine. The slot machine is configured with a base game and a bonus game. The player begins the game of chance by placing a wager 302 on the results of the random outcome of the spin of the reels on the base game. The first stage of player qualification for the bonus game is successfully aligning of one or more trigger symbols 304 in a predetermined arrangement on the reels of the base game. Then the second stage of player qualification is initiated by displaying the trigger symbols 306 to the player. The player then progresses by selecting 308 one or more of the displayed trigger symbols 306. Selecting a symbol causes it to display whether or not it is a qualifying symbol. Successful qualifying of the player for the bonus game is achieved when the player selects at least one trigger symbol 304 that is a qualifying trigger symbol 310. The player is then awarded the Bonus Qualifying win credits 314 and proceeds to play the bonus round. Alternatively, no Bonus Qualifying win credits 314 need be awarded, and instead the player may proceed directly to a bonus game. If the player has not qualified for the bonus round, awarded non-qualifier credits may be awarded 312. Note that in a preferred embodiment the player is choosing from among the trigger symbols themselves. However, in principle, the player may choose from any of the symbols, with each symbol having associated with it either qualification or non-qualification for the bonus game.

Figure 4:
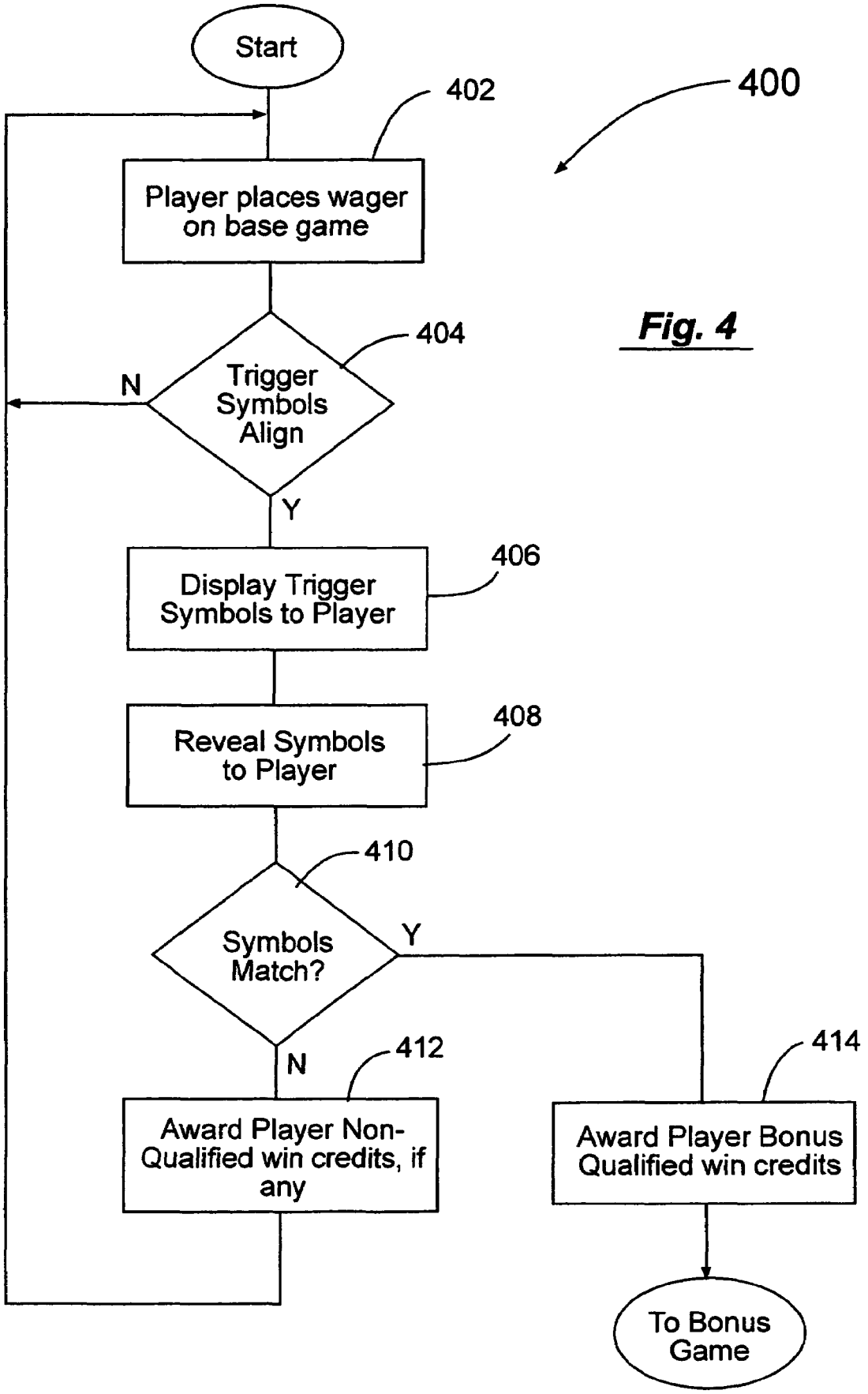
FIG. 4 is a flow diagram of another multi-stage bonus event.

In operation and referring to FIG. 4, another example 400 is based on a Mikohn Gaming Corporation of Las Vegas, Nev. game, Clue® 2 game. In this example, a two-stage method wins play of a "Mystery Trivia Bonus" game. Play begins with the player placing a wager 402 on the outcome of the random spinning of the reels in the base game. The trigger symbols 404 are preferably card backs that appear only on reels 2 and 4 of the base game. The player achieves the first stage if successful aligning a scatter-pay arrangement of trigger symbols on reels 2 and 4 of the base game 402. The scatter-pay arrangement is then displayed at 406 to the player. Thereafter, on the reels, the cards turn from their backs to the player to reveal their faces 408. A standard deck of Clue® cards is used (6 Suspects, 6 Weapons, 9 Rooms).

The types of cards as revealed on the faces are the bonus elements revealed in this example. In particular, if the two cards match 410 in type, that is, both are Suspect cards, both are Weapon cards, or both are Room cards, then the player qualifies for a bonus game. The player then progress into the bonus game 414. The bonus game could be any type of game including a game of trivia.

If the player has not qualified for the bonus game he may be awarded 412 the Non-Qualifying credits. In the preferred embodiment the non-Qualifying credits are based upon the relative probability of not matching card fronts and multiplier values for wagers are assigned accordingly. Revealed card fronts have different multipliers. Because there are more Room cards than Suspect or Weapon cards, the room cards have lower multiplier than Suspect or Weapon cards. In this embodiment a Suspect card is assigned a multiplier of 3 times the wager, the Weapon card is assigned a multiplier of 2 times the wager and the Room card is assigned a multiplier of 1 times the wager. That is to say, if the player does not qualify for the bonus game (the two cards do not match), the player is awarded the sum of the assigned multipliers. E.g., if the two cards turned to reveal a Suspect and a Room, the player would not qualify for the bonus game but would instead receive 4 times the total wager.

Given combination of 6 Suspect cards, 6 Weapon cards and 9 Room cards, the preferred embodiment of this example uses a conditional probability of match of a Suspect card and a Weapon card of 0.1633. The conditional probability of Suspect card and a Room card is 0.2449. The conditional probability of a Weapon card and a Room card is 0.2449. The conditional probability of Any Non-Qualified Triggers is 0.6531. The average expected value of the award multiplier (if not qualifying) is 2.53 times the amount of the wager. The conditional probability of Any Qualified Triggers is therefore $1-0.6531=0.3469$. Thus, for example, if the reels were designed to have the cards appear on reels 2 and 4 with probability 0.05, then the overall probability of advancing to the bonus game is therefore $0.05\times0.3469=0.0173$, or roughly 1 in every 58 spins. That is, roughly 1 in every 20 spins, the player will align the two cards and the player will at least have gotten "close" to getting to the bonus game, and of these, roughly 1 in every 3 will result in actual qualification.

Alternatives to this example include revealing one or more bonus elements such as a symbol, a value either multiple or number, index, or null, associated with at least one or more of the trigger symbols.

The player selecting two symbols to reveal the bonus element instead of the automatic revelation of the bonus element associated with the symbols.

The player revealing all the trigger symbols with trigger symbols where each contains one or more bonus elements.

The trigger symbols may have bonus elements that include a numerical value.

The player may select one or more bonus elements from a group consisting of; suspect, weapon, room.

The base game may depict the trigger symbols as cards.

The player may select the bonus element to attempt to match a group for a predetermined scheme.

The player may select bonus elements as matching numbers of a predetermined scheme.

Yet another example of qualifying a player for a bonus game uses two steps or stages on a slot machine configured with both a base game and bonus game. The player begins the event placing a wager on the random out come of spinning the base game reels. The first stage of player qualification for the bonus game is the successfully aligning of one or more trigger symbols in a predetermined arrangement on the reels of the base game. Then the second stage of the player qualification is initialed by displaying the trigger symbols to the player. The player then progresses by selecting a trigger symbol. Associated with each trigger symbol is either qualification or non-qualification. Whether a symbol reveals "qualify" or "non-qualify" is done via random process. For example, if it is desired that each symbol have X % chance of qualification, then a random integer number may be generated for each symbol in the range between 1 and 100. If the generated random integer is between 1 and X, then the attribute associated with the symbol is "qualify"; otherwise the attribute is "non-qualify". The player selects one of the symbols, which in turn reveals its attribute. Successful qualifying of the player for the bonus game is achieved when the player selects at least one mystery bonus elements symbol that is a qualifying mystery bonus element.

Another example of qualifying a player using a multistage bonus, preferably on video slot reels, uses two mystery dice symbols. These two symbols reveal themselves as a result of a random spin in the base game operation. After the two mystery dice symbols appear they each turn to reveal a random value of pips between 1 and 6 inclusive. If they match the bonus initiates (with $1/6$ conditional probability). If they match and are both sixes, then a higher bonus initiates (with $1/36$ conditional probability). A non-match can either award nothing or a pay.

Yet another example of qualifying a player using a multistage bonus is the use of two cards as symbols. As before these card symbols appear as the successful result of a random spin in the base game operation. After the card symbols appear they turn over to reveal their values. If their suits match then the bonus initiates (with $12/52$ conditional probability). If they are both red and their suits match, then the player is awarded a higher bonus (with $6/52$ conditional probability).

While the examples illustrating the method and apparatus and different options for embodiments of thereof are explained throughout the preceding disclosure, skilled artisans will appreciate that many variations of the execution will be possible. These card symbols could appear on a secondary screen instead of the video for the base game. The symbols can appear in place of those on base screen, e.g. that the symbols turn into something else. The specific examples should not be considered limiting and they are merely for depiction of some possible embodiments.

What is claimed:

1. A method for qualifying a player to play a bonus game from play of a casino base game, play of the casino base game providing a reel spin outcome on a plurality of reels occurring in response to a wager from the player, the casino base game paying the player an award for a winning combination of symbols in the reel spin outcome, and play of the bonus game occurring with a bonus-game occurrence probability during play of the casino base game, the method for qualifying comprising:

providing in the play of the casino base game in response to the wager a first stage qualifying arrangement of at least one bonus trigger symbol in the plurality of reels of the reel spin outcome, the first stage qualifying arrangement having a first probability of occurrence during play of the casino base game; each at least one bonus trigger symbol having randomly associated therewith either a non-qualifying bonus symbol or a bonus qualifying symbol;

selecting, by the player in the play of the casino base game, at least one bonus trigger symbol in the first stage qualifying arrangement only in response to when the first stage qualifying arrangement occurs in the provided reel spin outcome;

in response to the aforesaid selecting, the casino base game then causing each said selected bonus trigger symbol in the provided reel spin outcome to turn from the selected trigger symbol to reveal to the player, on said plurality of reels in said reel spin outcome of the casino base game, either the associated non-qualifying bonus symbol or the associated bonus qualifying symbol;

only the revealing of at least one said associated bonus qualifying symbol in the reel spin outcome providing a second stage qualifying arrangement in the play of the casino base game;

not providing the second stage qualifying arrangement in the play of the casino base game, and not providing any award for said selection, at least when each said selected trigger bonus symbol reveals to the player an associated non-qualifying bonus symbol;

the second stage qualifying arrangement having a second probability of occurrence during play of the casino base game, said bonus-game occurrence probability being a product of said first probability of occurrence and said second probability of occurrence, said first probability of occurrence and said second probability of occurrence each being less than one, wherein said first probability of occurrence is less than said second probability of occurrence;

commencing play, by the player, of the bonus game to receive a bonus award only in response to providing said second stage qualifying arrangement during play of the casino base game.

2. The method of claim 1 wherein said at least one bonus trigger symbol comprises a plurality of bonus trigger symbols and wherein said first stage qualifying arrangement is a line combination of said plurality of bonus trigger symbols in the reel spin outcome.

3. The method of claim 1 wherein said at least one bonus trigger symbol comprises a plurality of bonus trigger symbols and wherein said first stage qualifying arrangement is a scattered combination of said plurality of bonus trigger symbols in the reel spin outcome.

4. The method of claim 1 wherein said at least one bonus trigger symbol comprises a plurality of bonus trigger symbols and wherein said second stage qualifying arrangement in said reel spin outcome comprises a plurality of identical qualifying symbols.

5. A method for qualifying a player to play a bonus game from play of a casino base game, play of the casino base game providing a reel spin outcome on a plurality of reels occurring in response to a wager, the casino base game paying the player an award for a winning combination of symbols in the reel spin outcome, and play of the bonus game occurring with a bonus-game occurrence probability during play of the casino base game, the method for qualifying comprising:

providing in the play of the casino base game in response to the wager a first stage qualifying arrangement of at least one bonus trigger symbol in the plurality of reels of the reel spin outcome, the first stage qualifying arrangement having a first probability of occurrence during play of the casino base game; each at least one bonus trigger symbol having randomly associated therewith either a non-qualifying bonus symbol or a bonus qualifying symbol;

selecting, in play of the casino base game, at least one bonus trigger symbol in the first stage qualifying arrangement only in response to when the first stage qualifying arrangement occurs in the reel spin outcome;

in response to aforesaid selecting, the casino base game then causing each said selected bonus trigger symbol in the provided reel spin outcome to turn from the selected trigger symbol to reveal to the player, on said plurality of reels in said reel spin outcome of the casino base game, either the associated non-qualifying bonus symbol or the associated bonus qualifying symbol;

the displaying of at least one said associated bonus qualifying symbol in the reel spin outcome providing a second stage qualifying arrangement;

not providing the second stage qualifying arrangement, in the play of the casino base game and not providing any award for said selection, when each said selected trigger bonus symbol reveals to the player an associated non-qualifying bonus symbol;

the second stage qualifying arrangement having a second probability of occurrence during play of the casino base game, said bonus-game occurrence probability being a product of said first probability of occurrence and said second probability of occurrence, said first probability of occurrence and said second probability of occurrence each being less than one, wherein said first probability of occurrence is less than said second probability of occurrence;

commencing play, by the player, of the separate bonus game to receive a bonus award when providing said second stage qualifying arrangement during play of the casino base game.

6. The method of claim 5 wherein said selecting comprises:

selecting said at least one bonus trigger symbol by said player.

7. The method of claim 5 wherein said selecting comprises:

selecting said at least one bonus trigger symbol automatically.

8. A method for qualifying a player to play a bonus game from play of a casino base game, play of the casino base game providing a reel spin outcome on a plurality of reels occurring in response to a wager, the casino base game paying the player an award for a winning combination of symbols in the reel spin outcome and play of the bonus game occurring with a bonus-game occurrence probability during play of the casino base game, the method for qualifying comprising:

providing in the play of the casino base game in response to the wager a first stage qualifying arrangement of a plurality of bonus trigger symbols in the plurality of reels of the reel spin outcome, the first stage qualifying arrangement having a first probability of occurrence during play of the casino base game;

selecting, in the play of the casino base game, at least two of the plurality of bonus trigger symbols in the first stage qualifying arrangement only in response to when the first stage qualifying arrangement occurs in the provided reel spin outcome;

turning each of the selected at least two bonus trigger symbols, in the play of the casino base game, over to reveal a second stage bonus element, thereby providing at least two revealed second stage bonus elements;

when the revealed at least two second stage bonus elements match, providing a second stage qualifying arrangement in the play of the casino base game; when the revealed at least two second stage bonus elements do not match not playing the bonus game and not providing an award;

the second stage qualifying arrangement having a second probability of occurrence during play of the casino base game, the bonus game play probability being a product of said first probability of occurrence and said second probability of occurrence, said first probability of occurrence and said second probability of occurrence each being less than one wherein said first probability of occurrence is less than said second probability of occurrence;

commencing play of the bonus game to receive a bonus award only in response to when the at least two bonus elements match during play of the casino base game and in response to ending play of the casino base game.

9. The method of claim 8 wherein said selected at least two bonus trigger symbols are card backs.

10. The method of claim 8 wherein said at least two revealed second stage bonus elements are suspect cards.

11. The method of claim 8 wherein said at least two revealed second stage bonus elements are weapon cards.

12. The method of claim 8 wherein said at least two revealed second stage bonus elements are room cards.

13. The method of claim 8 wherein said bonus game is a trivia game.

14. The method of claim 12 wherein the second stage qualifying arrangement comprises a predetermined number of bonus elements, having at least one characteristic in common, in said reel spin outcome.

15. The method of claim 14 wherein said at least one characteristic in common comprises at least two card faces having a common card type in said reel spin outcome.

16. The method of claim 14 wherein said at least one characteristic in common comprises at least two numbers of equal value in said reel spin outcome.

17. The method of claim 14 wherein said at least one characteristic in common comprises at least two dice symbols of equal value in said reel spin outcome.

* * * * *

UNITED STATES PATENT AND TRADEMARK OFFICE

CERTIFICATE OF CORRECTION

PATENT NO. : 7,172,505 B2
APPLICATION NO. : 10/166976
DATED : February 6, 2007
INVENTOR(S) : Olaf Vancura It is certified that error appears in the above-identified patent and that said Letters Patent is hereby corrected as shown below:

Column 8, claim 14, line 52, "12" should be changed to -- 8 --

Signed and Sealed this

First Day of May, 2007

JON W. DUDAS
*Director of the United States Patent and Trademark Office*